US011933496B1

(12) United States Patent
Gao

(10) Patent No.: US 11,933,496 B1
(45) Date of Patent: Mar. 19, 2024

(54) SELF-GENERATING MOVABLE HEAT SOURCE

(71) Applicant: Qinglong Gao, Heilongjiang (CN)

(72) Inventor: Qinglong Gao, Heilongjiang (CN)

( * ) Notice: Subject to any disclaimer, the term of this patent is extended or adjusted under 35 U.S.C. 154(b) by 0 days.

(21) Appl. No.: 18/241,134

(22) Filed: Aug. 31, 2023

(51) Int. Cl.
*F23M 5/08* (2006.01)

(52) U.S. Cl.
CPC ..... *F23M 5/08* (2013.01); *F23M 2900/13003* (2013.01)

(58) Field of Classification Search
None
See application file for complete search history.

(56) References Cited

U.S. PATENT DOCUMENTS

| | | | | |
|---|---|---|---|---|
| 10,543,735 | B2 | 1/2020 | Colavincenzo | |
| 10,928,761 | B2 | 2/2021 | Adachi et al. | |
| 2014/0230869 | A1 * | 8/2014 | Chen | F24D 18/00 136/201 |

FOREIGN PATENT DOCUMENTS

| | | | | |
|---|---|---|---|---|
| CN | 202160135 | U * | 3/2012 | |
| CN | 103629811 | A * | 3/2014 | |
| CN | 205901634 | U * | 1/2017 | |
| DE | 102018000457 | A1 * | 7/2019 | |
| EP | 2840328 | A1 * | 2/2015 | F24H 1/43 |
| WO | WO-2006136148 | A1 * | 12/2006 | B60H 1/00 |

* cited by examiner

*Primary Examiner* — Jason Lau
(74) *Attorney, Agent, or Firm* — Che-Yang Chen; Law Office of Michael Chen

(57) ABSTRACT

A self-generating movable heat source may include a burner, a heat exchanger, a plurality of sets of thermoelectric power generation modules, a plurality of sets of radiators, a shell, a combustion-supporting cooling fan assembly, a thermoelectric power generation module fixed frame, an integrated graphite pad, a plurality of sets of outer hexagonal stud screws, spring pads, nuts, Y-shaped pressing pieces, I-shaped pressing pieces, L-shaped pressing pieces, a power management system, and a lithium battery pack. In one embodiment, the burner, the heat exchanger, the plurality of sets of thermoelectric power generation modules, the thermoelectric power generation module fixed frame, the integrated graphite pad, and the plurality of sets of radiators are sequentially arranged in the shell from the inside to the outside.

10 Claims, 13 Drawing Sheets

(a)

(b)

SELF-GENERATING MOVABLE HEAT SOURCE

FIELD OF THE INVENTION

The present invention relates to the field of thermoelectric technology, particularly relates to a self-generating movable heat source.

BACKGROUND OF THE INVENTION

Generally, fuel heating equipment or burning wood coal is adopted for heating in the outdoors; however, for continuous heating for ordinary fuel equipment, additional external power supply must be provided to supply power for drive systems such as fan, to ensure the continuous operation of the equipment. Generally, there is no main power supply outdoors, and batteries are commonly used for outdoor power supply, however batteries have the shortcomings such as large volume, heavy weight, small power storage and slow charging speed, etc. Burning coal and wood for heating is easy to produce carbon monoxide, resulting in human poisoning and easily causing fire hazards.

SUMMARY OF THE INVENTION

Conventional fuel heating equipment is disadvantageous because the fuel heater needs additional external power supply, and there is great drawback to use the battery for power supply. Thus, a self-generating movable heat source is provided in the present invention.

In one embodiment, a self-generating movable heat source, comprising a burner, a heat exchanger, a plurality of sets of thermoelectric power generation modules, a plurality of sets of radiators, a shell, a combustion-supporting cooling fan assembly, a thermoelectric power generation module fixed frame, an integrated graphite pad, a plurality of sets of outer hexagonal stud screws, spring pads, nuts, Y-shaped pressing pieces, I-shaped pressing pieces, L-shaped pressing pieces, a power management system, and a lithium battery pack; the burner, the heat exchanger, the plurality of sets of thermoelectric power generation modules, the thermoelectric power generation module fixed frame, the integrated graphite pad, and the plurality of sets of radiators are sequentially arranged in the shell from the inside to the outside, the combustion-supporting cooling fan assembly is arranged on one side of the heat exchanger; the burner is inserted into the heat exchanger and connected fixedly with the heat exchanger; the plurality of sets of thermoelectric power generation modules, the thermoelectric power generation module fixed frame, the integrated graphite pad, and the plurality of sets of radiators are uniformly mounted on the outer wall of the heat exchanger in the circumferential direction from inside to outside, and then compress and fix all fittings by means of the plurality of sets of outer hexagonal stud screws, the spring pads, the nuts, the Y-shaped pressing pieces, the I-shaped pressing pieces, and the L-shaped pressing pieces.

Further, each set of radiators comprises a cooling fin body and a rectifying cover plate, after the cooling fin body is mounted, the rectifying cover plate is inserted into a fixing groove of the cooling fin body.

Further, each set of outer hexagonal stud screw comprises a short limit outer hexagonal stud screw and a long limit outer hexagonal stud screw, the short limit outer hexagonal stud screw has a short hexagon, and the threaded part is inserted into the radiators, the long limiter outer hexagonal stud screw has a long hexagon and abuts against the end surface of the hexagon when the pressing piece is pressed.

Further, the outer wall of the heat exchanger is in the shape of a hexagonal prism, which is a barrel-shaped structure with one end open; the inner wall of the heat exchanger is evenly provided with a plurality of heat exchange fins along the circumferential direction, and the length direction of the heat exchange fins is the same as the length direction of the burner.

Further, the Y-shaped pressing pieces, the I-shaped pressing pieces, and the L-shaped pressing pieces have different structural shapes depending on different mounting positions.

Further, the integrated graphite pad is disposed above the heat exchanger, and then the thermoelectric power generation module fixed frame is disposed above the integrated graphite pad, the heat exchanger is provided with 4 threaded holes corresponding to the holes on the thermoelectric power generation module fixed frame and the integrated graphite pad, and then the short limit outer hexagonal stud screw passes through the holes on the thermoelectric power generation module fixed frame and the integrated graphite pad, and is screwed into the two threaded holes in the middle of the heat exchanger, and then the long limit outer hexagonal stud screw passes through the holes on the thermoelectric power generation module fixed frame and the integrated graphite pad, and is screwed into the two threaded holes at both ends of heat exchanger, and by means of the hexagonal end surface of the outer hexagonal stud screw, the thermoelectric power generation module fixed frame and the integrated graphite pad are securely fixed on the heat exchanger, and then the thermoelectric power generation modules are disposed into the groove of the thermoelectric power generation module fixed frame to position and fix the thermoelectric power generation modules.

Further, the integrated graphite pad is disposed on the thermoelectric power generation modules through the outer hexagonal stud screw, and the cooling fin body is disposed on the integrated graphite pad through the outer hexagonal stud screw, and then the Y-shaped pressing pieces, the I-shaped pressing pieces and the L-shaped pressing pieces are disposed on the cooling fin body through the outer hexagonal stud screw depending on different positions, and then the spring pads and nuts are sleeved on the outer hexagonal stud screw and the nuts are tightened, so that the lower planes of the Y-shaped pressing pieces, the I-shaped pressing pieces and the L-shaped pressing pieces abut against the upper surface of the hexagon of the outer hexagonal stud screw, and the rectifying cover plate is inserted into the fixing groove of the cooling fin body.

Further, the combustion-supporting cooling fan assembly comprises a drive motor, a combustion-supporting impeller, a cooling impeller, a limit bracket and a motor aluminum seat, the combustion-supporting impeller and the cooling impeller are mounted on the shaft body at both ends of the drive motor respectively, wherein the size of the combustion-supporting impeller is smaller than the size of the cooling impeller, and the limit bracket fixes the position of the combustion-supporting cooling fan assembly to avoid the scrape of the shell by the cooling impeller.

Further, the shell is a cylindrical structure, and two ends of the shell are provided with air inlets and air outlets.

Further, two connecting wires on the thermoelectric power generation modules are connected to the power management system, and two connecting wires of the lithium battery pack are also connected to corresponding positions of the power management system.

Compared with the prior art, the present invention has the following beneficial effects:

1. In the present invention, the fuel is delivered to the burner through the external fuel supply system, and then ignited by the igniter. The combustion-supporting impeller rotates to provide oxygen, and the fuel burns in the burner to provide heat energy. The heat is conducted to the heat exchanger, and then conducted to radiators by means of the integrated graphite pad and the thermoelectric power generation modules, so that a temperature difference between the upper and lower surfaces of the thermoelectric power generation modules is generated; while the supply of heat energy is not affected, the thermoelectric power generation modules generate electricity, and the generated electricity will be sent to the power management system which distributes the power to the equipment and recharges the lithium battery pack to achieve the purpose of continuous work.
2. In the present invention, integrated graphite pads are disposed on the upper and lower surfaces of the thermoelectric power generation modules. The integrated graphite pads are soft in texture, so as to realize soft filling between heat exchanger and thermoelectric power generation modules, and between thermoelectric power generation modules and radiators, reduce the gaps, increase the contact area, accelerate the heat conduction speed and produce large heat conduction, achieving the optimal heat conduction performance. Meanwhile, the integrated graphite pads have good longitudinal heat conduction performance, and the heat in the high temperature position of the integrated graphite pad can be longitudinally transmitted to the low temperature position, so as to achieve the purpose of temperature balance and improving the thermal conductivity.
3. In the present invention, outer hexagonal stud screws are used to fix all parts. The outer hexagonal stud screws include short limit outer hexagonal stud screws and long limit outer hexagonal stud screws. The short limit outer hexagonal stud screws have short hexagons and play the roles of avoidance, so as not to abut against the radiators; and the threaded part is inserted into the radiators. The long limit outer hexagonal stud screws have long hexagons; when pressing, the pressing pieces abut against the end surface of the hexagons, which plays a role of limiting and ensures consistent pressing force of each pressing piece.
4. In the present invention, the thermoelectric power generation module fixed frame is used to fix the thermoelectric power generation modules. Because thermoelectric power generation modules are composed of multiple thermoelectric power generation pieces connected in series and their shapes are irregular and difficult to be fixed, a thermoelectric power generation module fixed frame is used. Firstly, the outer hexagonal stud screw is used to fix the integrated graphite pad and the thermoelectric power generation module fixed frame in the heat exchanger, and then the thermoelectric power generation modules are placed into a groove of the thermoelectric power generation module fixed frame; thus, the thermoelectric power generation modules are positioned and fixed, which solves the problem of difficulty to position and fix the thermoelectric power generation modules and improves the efficiency of installation and production to a great extent.
5. In the present invention, the power management system and lithium battery pack are used. When the equipment is working, the thermoelectric power generation modules will send power to the power management system, which will then send power to the electrical components and recharge the lithium battery pack by means of judgment and distribution. The lithium battery pack is composed of multiple lithium batteries. When there is under voltage, the lithium battery pack can be pulled out, and the mains charging and on board charging can be adopted, which is convenient to use.

BRIEF DESCRIPTION OF THE DRAWINGS

The accompanying drawings are provided to further illustrate the present invention and are included as a part of the present invention.

DETAILED DESCRIPTION OF THE PRESENT INVENTION

In order to make the object, technical solutions and advantages of the embodiments of the present invention clearer, the technical solutions in the embodiments will be described below in conjunction with the drawings in the embodiments of the present invention in a clear and complete manner. The following embodiments are used to illustrate the present invention, but not to limit the scope of the present invention.

Figure 1:
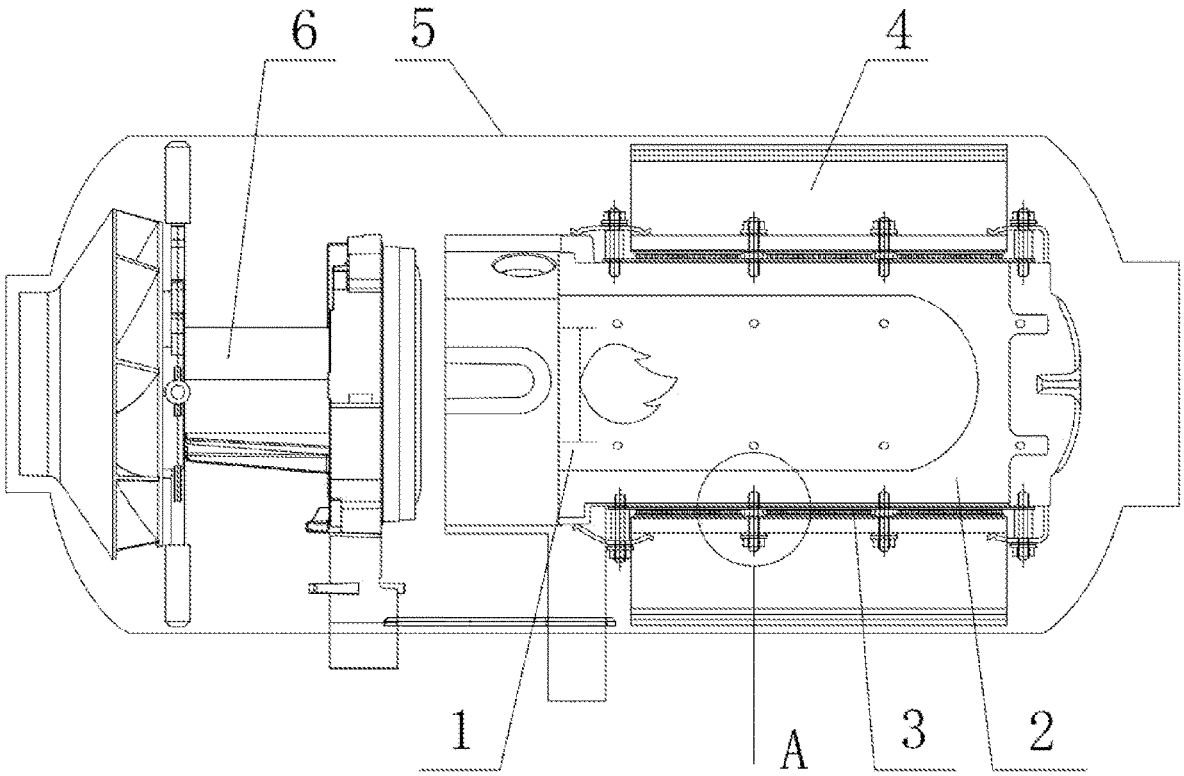
FIG. 1 is a schematic diagram of an overall structure of the present invention.

Referring to FIG. 1, the embodiments of the present invention provide a self-generating movable heat source, comprising a burner 1, a heat exchanger 2, a plurality of sets of thermoelectric power generation modules 3, a plurality of sets of radiators 4, a shell 5, a combustion-supporting cooling fan assembly 6, a thermoelectric power generation module fixed frame 7, an integrated graphite pad 8, a plurality of sets of outer hexagonal stud screws 9, spring pads 10, nuts 11, Y-shaped pressing pieces 12, I-shaped pressing pieces 13, L-shaped pressing pieces 14, a power management system 15, and a lithium battery pack 16. In one embodiment, the burner 1, the heat exchanger 2, the plurality of sets of thermoelectric power generation modules 3, the thermoelectric power generation module fixed frame 7, the integrated graphite pad 8, and the plurality of sets of radiators 4 are sequentially arranged in the shell 5 from the inside to the outside. The combustion-supporting cooling fan assembly 6 is arranged on one side of the heat exchanger 2; and the burner 1 is inserted into the heat exchanger 2 and connected with the heat exchanger 2. The plurality of sets of thermoelectric power generation modules 3, the thermoelectric power generation module fixed frame 7, the integrated graphite pad 8, and the plurality of sets of radiators 4 are uniformly mounted on the outer wall of the heat exchanger 2 in the circumferential direction from inside to outside, and then compress and fix all fittings by means of the plurality of sets of outer hexagonal stud screws 9, the spring pads 10, the nuts 11, the Y-shaped pressing pieces 12, the I-shaped pressing pieces 13, and the L-shaped pressing pieces 14.

Referring to FIG. 1, the burner 1 is inserted into the heat exchanger 2 and connected with the heat exchanger 2 by means of screws; the burner 1 is connected to the oil pipe of the fuel supply system, and is mounted with an ignition plug; the fuel supplied by the fuel supply system burns in the burner 1 under the ignition of the ignition plug to generate heat.

Figure 3:
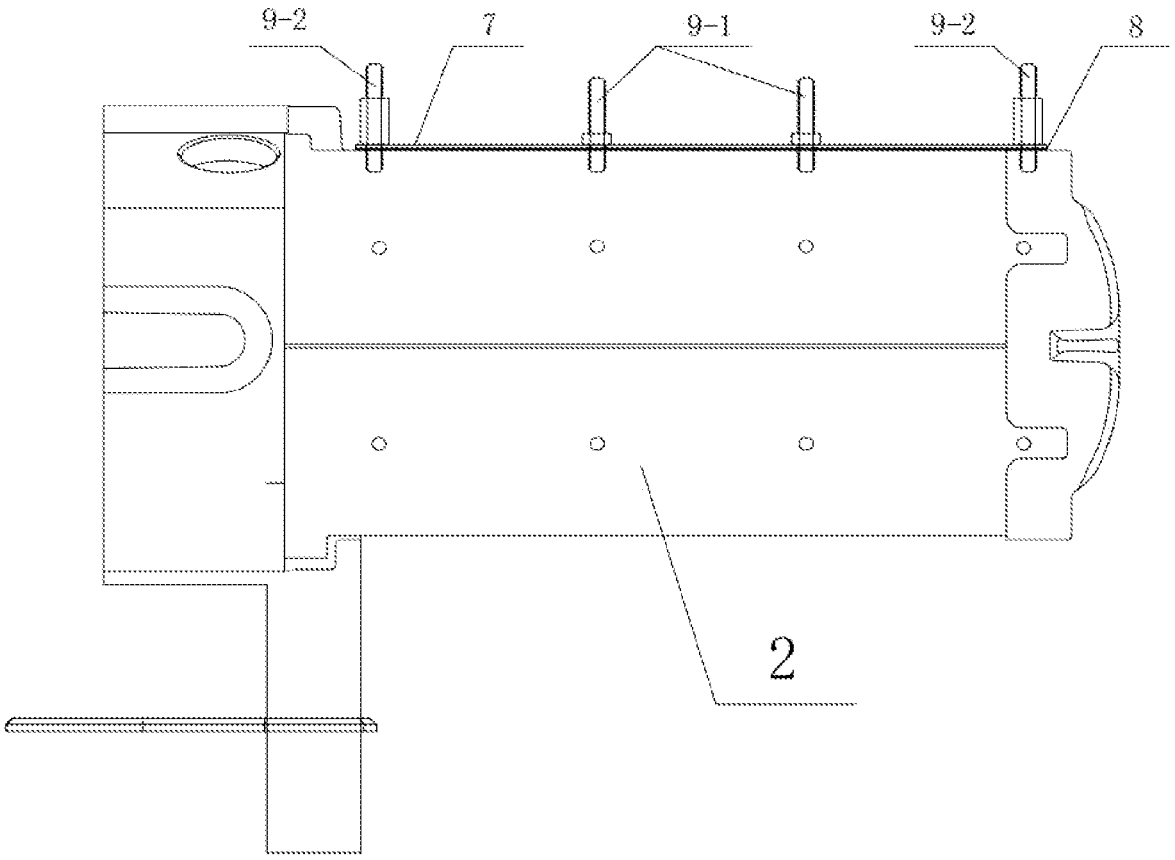
FIG. 3 is a side view of a heat exchanger.
Figure 4:
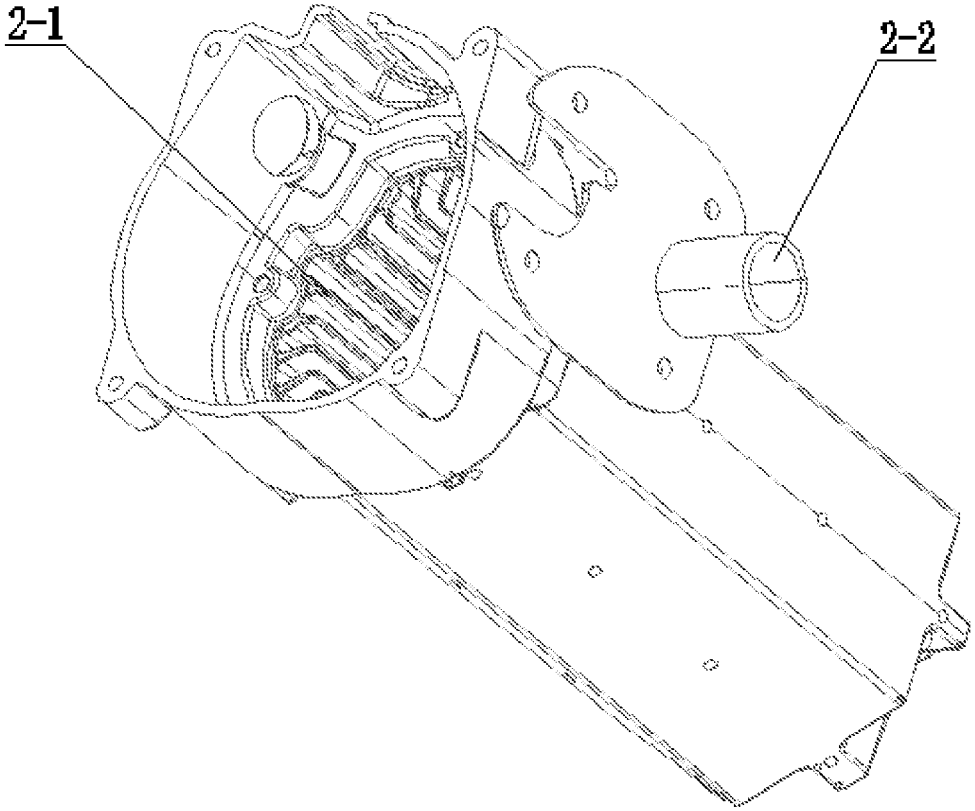
FIG. 4 is an axonometric view of a heat exchanger.

Referring to FIG. 3 and FIG. 4, the heat exchanger 2 is a barrel-shaped structure with one end open, to realize the heat exchange between the burner 1 and the plurality of sets of thermoelectric power generation modules 3; the inner wall of the heat exchanger 2 is evenly provided with a plurality of heat exchange fins 2-1 along the circumferential direction, and the length direction of the heat exchange fins 2-1 is the same as the length direction of the burner 1; the heat exchange fin 2-1 is used to increase the heat exchange area between the heat exchanger 2 and the burner 1 and increase the heat exchange efficiency.

Further, the outer wall of the heat exchanger 2 is in the shape of a hexagonal prism, and a set of thermoelectric power generation modules 3, a thermoelectric power generation module fixed frame 7, an integrated graphite pad 8 and a set of radiators 4 are mounted on each surface plate of the outer wall of the heat exchanger 2 to realize the power generation of the thermoelectric power generation modules 3.

In the present embodiment, the exterior of the heat exchanger 2 is designed to be a hexagonal prism, and there are a plurality of screw holes on each surface plate for fixing the radiators 4; the heat exchanger 2 has a small overall volume and a large heat exchange effective area to assemble, and is capable of assembling more thermoelectric power generation modules 3.

Figure 2:
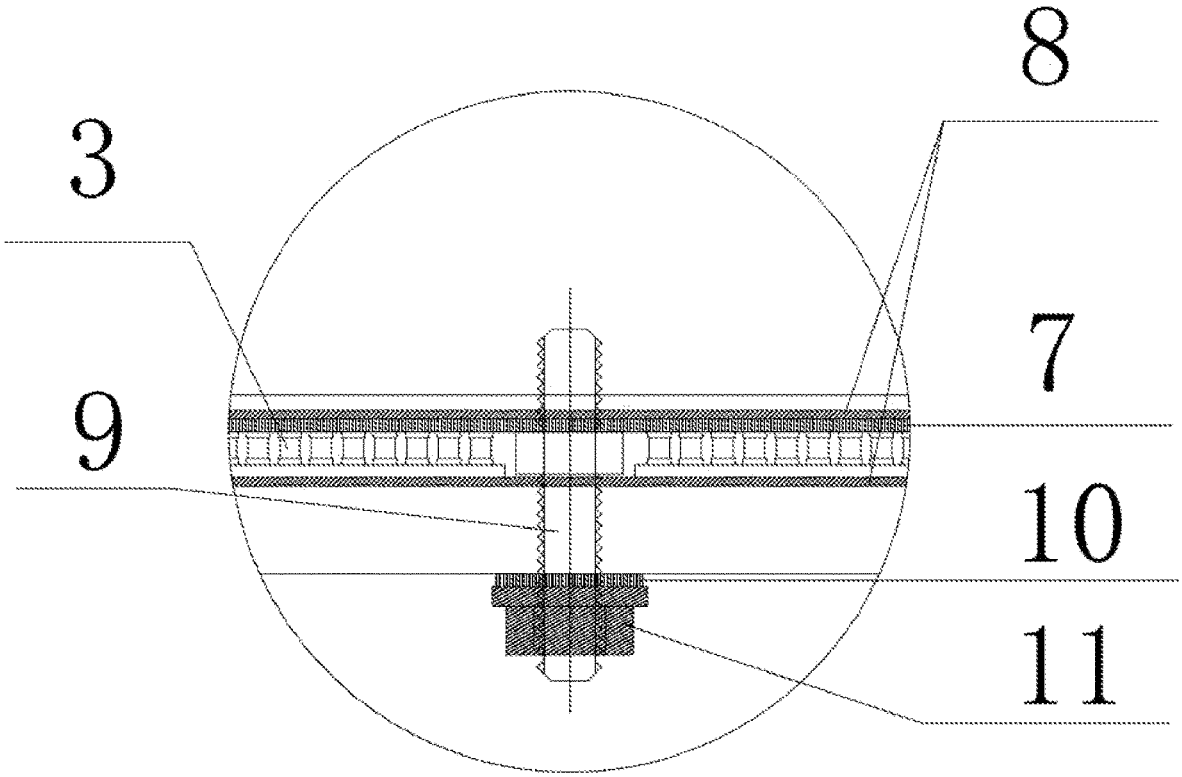
FIG. 2 is a partial enlarged view of A in FIG. 1.

Referring to FIG. 2, the integrated graphite pad is disposed above the heat exchanger, then the thermoelectric power generation module fixed frame is disposed above the integrated graphite pad, and then the outer hexagonal stud screw passes through the holes on the thermoelectric power generation module fixed frame and the integrated graphite pad, and is screwed into the threaded holes of the heat exchanger; by means of the hexagonal end surface of the outer hexagonal stud screw, the thermoelectric power generation module fixed frame and the integrated graphite pad are securely fixed on the heat exchanger, and then the thermoelectric power generation modules are disposed into the groove of the thermoelectric power generation module fixed frame to position and fix the thermoelectric power generation modules.

In the present embodiment, for the thermoelectric power generation modules 3, due to the temperature difference, one integrated graphite pad 8 is provided on the upper surface and the lower surface of the thermoelectric power generation module respectively; the integrated graphite pad 8 has a heat conduction function; the integrated graphite pad 8 on the lower surface is used for conduction of the heat energy of the heat exchanger 2, and the integrated graphite pad 8 on the upper surface is used for conduction of cold energy of the radiator 4, so that the heat on the upper and lower surfaces of the thermoelectric power generation module is different, and the power generation is realized through the temperature difference; the thermoelectric power generation module 3 is connected to the power management system by means of a connecting line.

In the present embodiment, the integrated graphite pads 8 are soft in texture, so as to realize soft filling between the heat exchanger 2 and the thermoelectric power generation modules 3, and between thermoelectric power generation modules 3 and radiators 4, reduce the gaps, increase the contact area, accelerate the heat conduction speed and produce large heat conduction, achieving the optimal heat conduction performance. Meanwhile, the integrated graphite pads 8 have good longitudinal heat conduction performance, and the heat in the high temperature position of the integrated graphite pad 8 can be longitudinally transmitted to the low temperature position, so as to achieve the purpose of temperature balance and improving the thermal conductivity.

Figure 5:
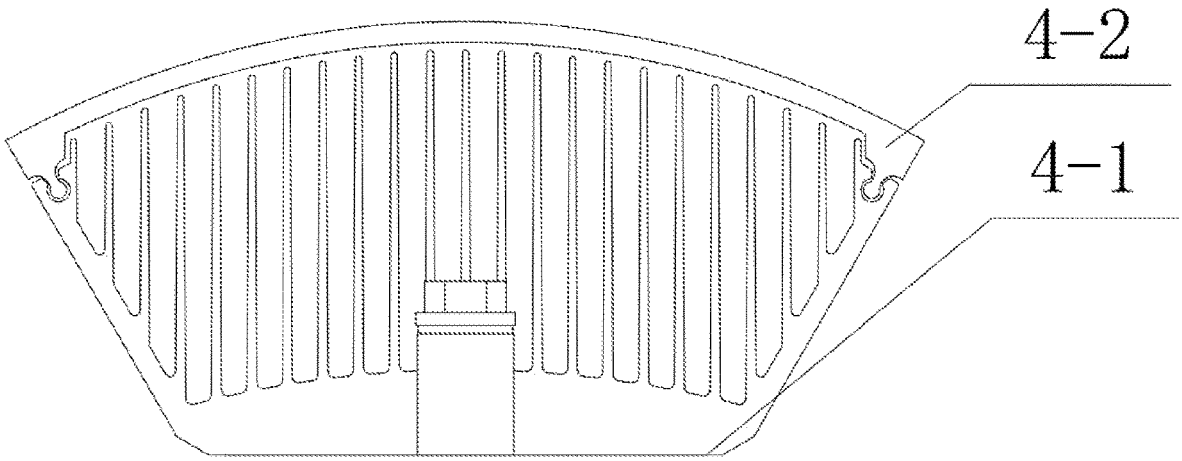
FIG. 5 is a structural representation of a radiator.
Figure 11:
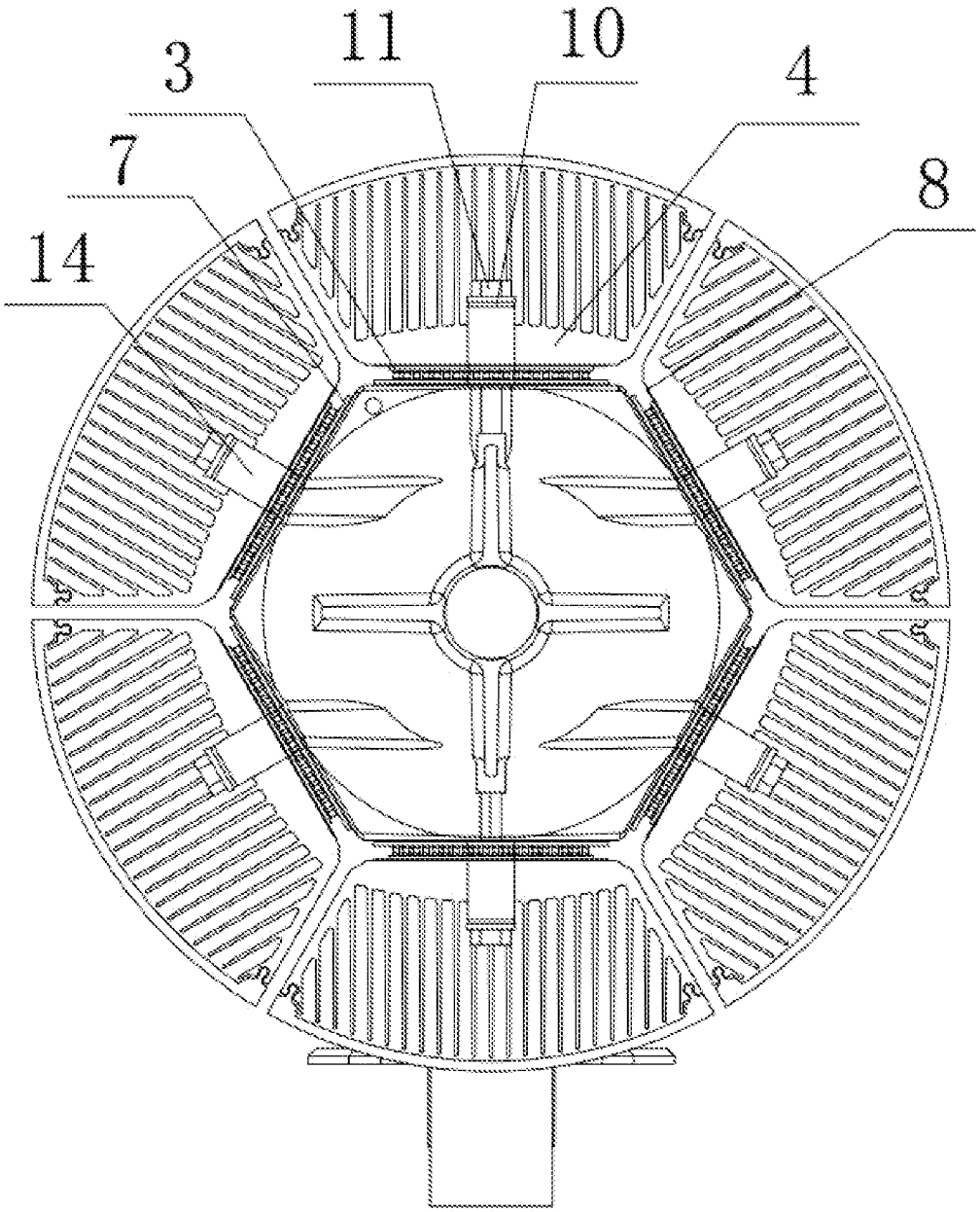
FIG. 11 is a front view of an overall structure.
Figure 12:
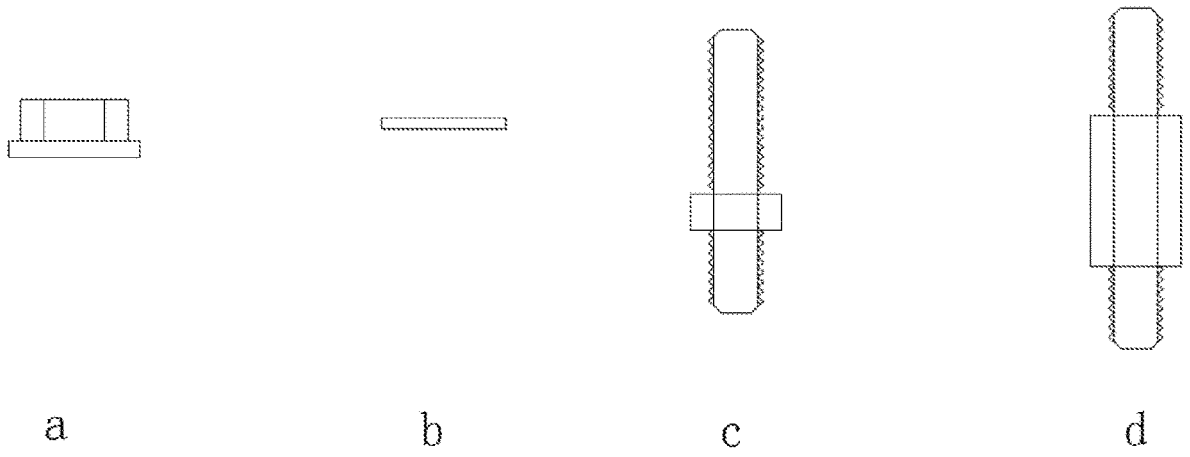
FIG. 12 is a schematic diagram of a fastener: a is a nut; b is a spring pad; c is a short limit outer hexagonal stud screw; d is a long limit outer hexagonal stud screw.

Referring to FIG. 1, FIG. 5 and FIG. 11, each set of radiators 4 comprises a cooling fin body 4-1 and a rectifying cover plate 4-2. The integrated graphite pad is disposed above the heat exchanger 2, and then the thermoelectric power generation module fixed frame 7 is disposed above the integrated graphite pad 8, the heat exchanger 2 is provided with 4 threaded holes corresponding to the holes on the thermoelectric power generation module fixed frame 7 and the integrated graphite pad 8, and then the short limit outer hexagonal stud screw 9-1 passes through the holes on the thermoelectric power generation module fixed frame 7 and the integrated graphite pad 8, and is screwed into the two threaded holes in the middle of the heat exchanger 2, and then the long limit outer hexagonal stud screw 9-2 passes through the holes on the thermoelectric power generation module fixed frame 7 and the integrated graphite pad 8, and is screwed into the two threaded holes at both ends of heat exchanger 2, and by means of the hexagonal end surface of the outer hexagonal stud screw 9, the thermoelectric power generation module fixed frame 7 and the integrated graphite pad 8 are securely fixed on the heat exchanger 2, and then the thermoelectric power generation modules 3 is disposed into the groove of the thermoelectric power generation module fixed frame 7 to position and fix the thermoelectric power generation modules 3. Then the integrated graphite pad 8 is disposed on the thermoelectric power generation modules 3 through the outer hexagonal stud screw 9, and the cooling fin body 4-1 is disposed on the integrated graphite pad 8 through the outer hexagonal stud screw 9, and then the Y-shaped pressing pieces 12, the I-shaped pressing pieces 13 and the L-shaped pressing pieces 14 are disposed on the cooling fin body 4-1 through the outer hexagonal stud screw 9 depending on different positions, and then the spring pads 10 and nuts 11 are sleeved on the outer hexagonal stud screw 9 and the nuts 11 are tightened, so that the lower planes of the Y-shaped pressing pieces 12, the I-shaped pressing pieces 13 and the L-shaped pressing pieces 14 abut against the upper surface of the hexagon of the outer hexagonal stud screw 9, and the rectifying cover plate 4-2 is inserted into the fixing groove of the cooling fin body 4-1.

In the present embodiment, after the thermoelectric power generation modules 3 are positioned by the thermoelectric power generation module fixed frame 7, the position is fixed through the connection between the radiators 4 and the heat exchanger 2. In order to ensure the stability of the connection between the radiators 4 and the heat exchanger 2, and the compactness of thermoelectric power generation modules 3 in contact with radiators 4 and heat exchanger 2, the radiators 4 need to be fixed by multiple outer hexagonal stud screws 9 and multiple sets of Y-shaped pressing pieces 12, I-shaped pressing pieces 13 and L-shaped pressing pieces 14.

Figure 6:
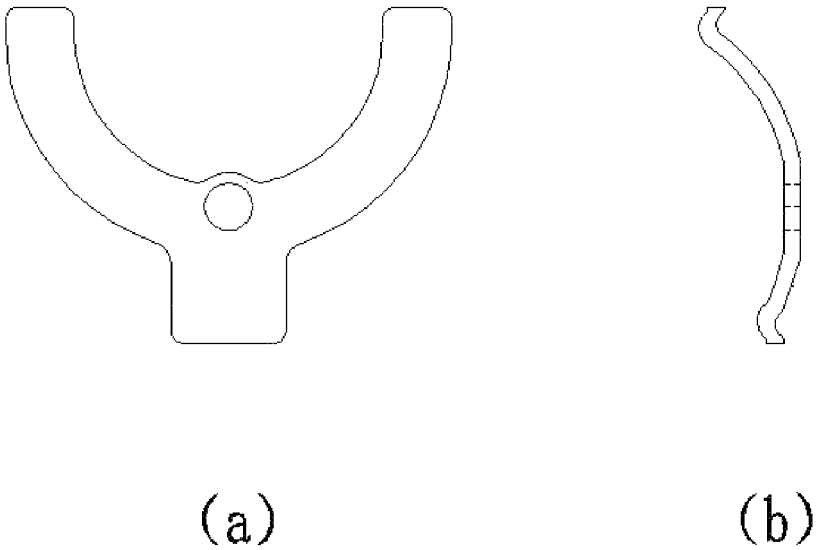
FIG. 6 is a structural representation of a Y-shaped pressing piece; (a) is a front view of a Y-shaped pressing piece; (b) is a side view of a Y-shaped pressing piece.
Figure 7:
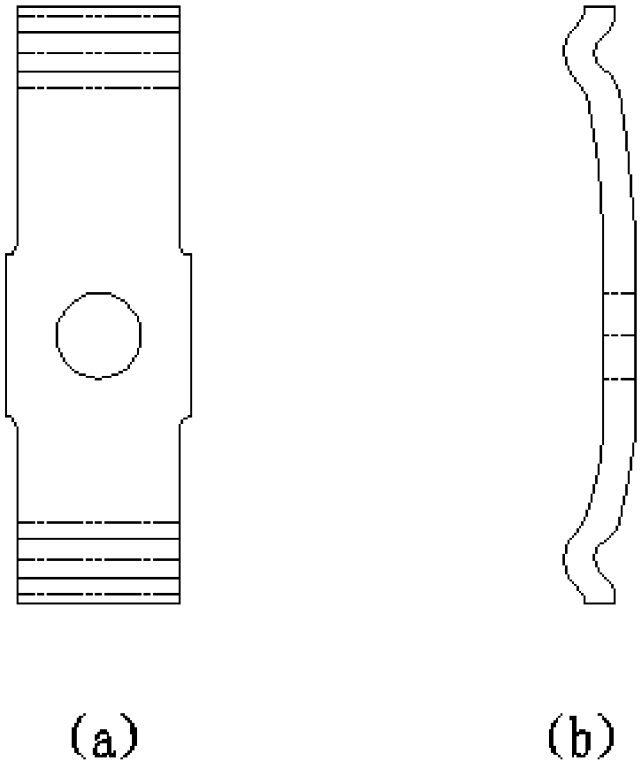
FIG. 7 is a structural representation of an I-shaped pressing piece: (a) is a front view of an I-shaped pressing piece; (b) is a side view of an I-shaped pressing piece.
Figure 8:
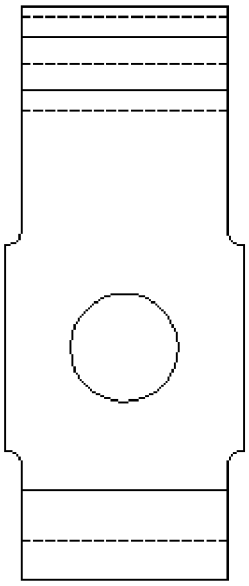
FIG. 8 is a structural representation of an L-shaped pressing piece; (a) is a front view of an L-shaped pressing piece; (b) is a side view of an L-shaped pressing piece.
Figure 8:
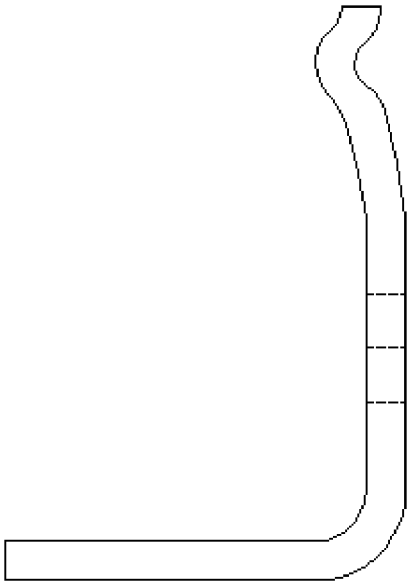

Further, the Y-shaped pressing pieces 12, I-shaped pressing pieces 13, and L-shaped pressing pieces 14 have different structural shapes depending on different mounting positions, specifically include three types, as shown in FIG. 6, FIG. 7 and FIG. 8. One type is Y-shaped pressing pieces 12, when the radiators 4 are located at the smoke outlet 2-2, the mounting space of the pressing piece is small, so the Y-shaped pressing pieces 12 are used. The middle position of the Y-shaped pressing pieces 12 is screwed on the heat exchanger 2, and the two claws on the top of the Y-shaped pressing pieces 12 are supported on the platforms on both sides of the exhaust port 2-2 of the heat exchanger 2, and one claw at the bottom of the Y-shaped pressing pieces 12 is pressed against the fulcrum plane of the radiators 4; Another type is I-shaped pressing pieces 13, when the fulcrum step of heat exchanger 2 is at the same level as the fulcrum plane of radiators 4, use I-shaped pressing pieces 13, the I-shaped pressing pieces 13 are used; the middle positions of the I-shaped pressing pieces 13 are screwed on the heat exchanger 2; the two ends of the I-shaped pressing pieces 13 are supported on the fulcrum step of the heat exchanger 2 and the fulcrum plane of the radiators 4 respectively. The last type is the L-shaped pressing pieces 14. Since the tail fulcrum step of the heat exchanger 2 is lower than the height of the fulcrum plane of the radiators 4, the L-shaped pressing pieces 14 are used, the middle positions of the L-shaped pressing pieces 14 are screwed on the heat exchanger 2, and the two ends of the L-shaped pressing pieces 14 abut against the tail fulcrum step of the heat exchanger 2 and the fulcrum plane of the radiators 4 respectively.

Referring to FIG. 1, the shell 5 is a cylindrical structure, and two ends of the shell 5 are provided with air inlets and outlets.

Figure 9:
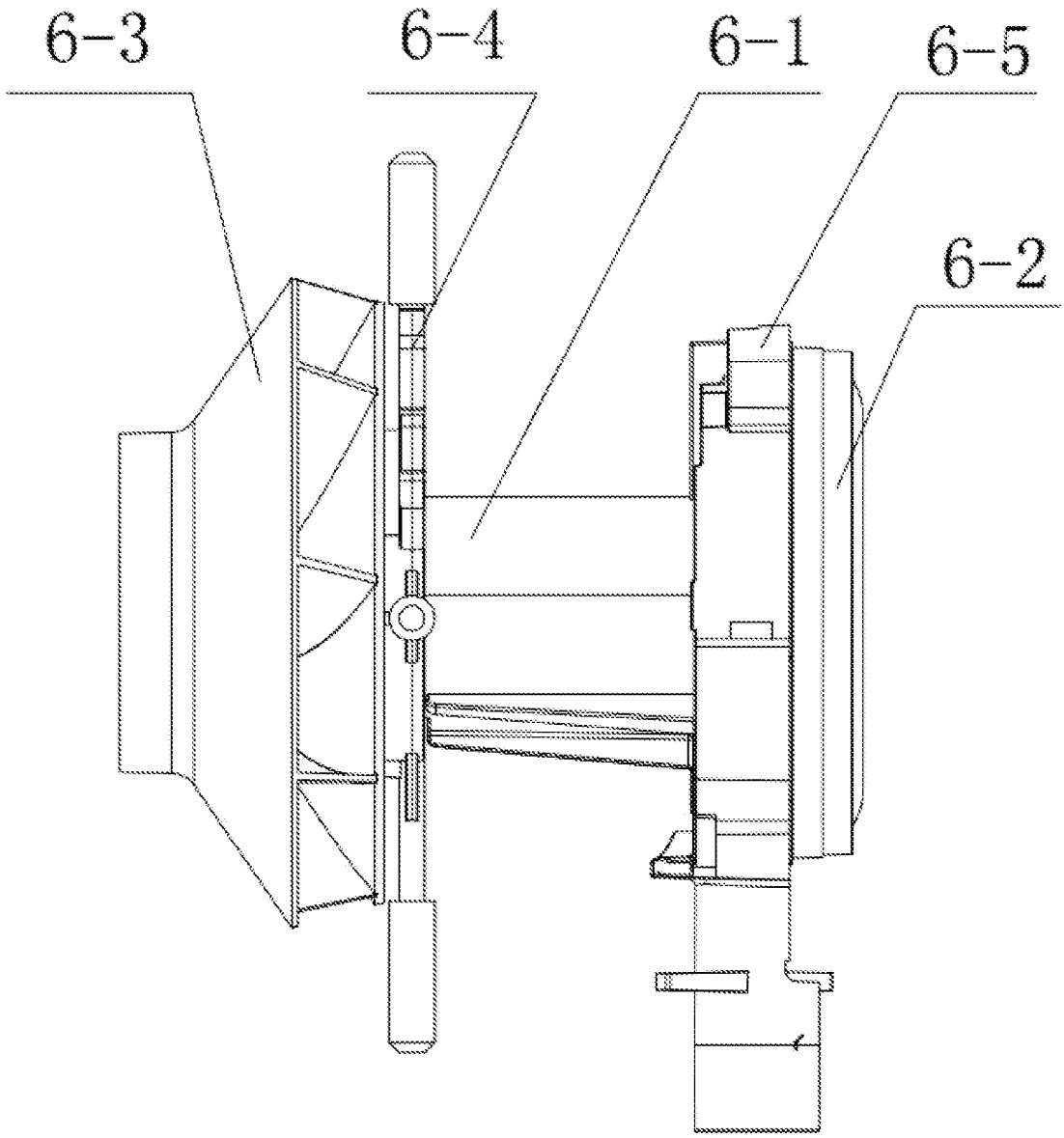
FIG. 9 is a structural representation of a combustion-supporting cooling fan assembly.
Figure 10:
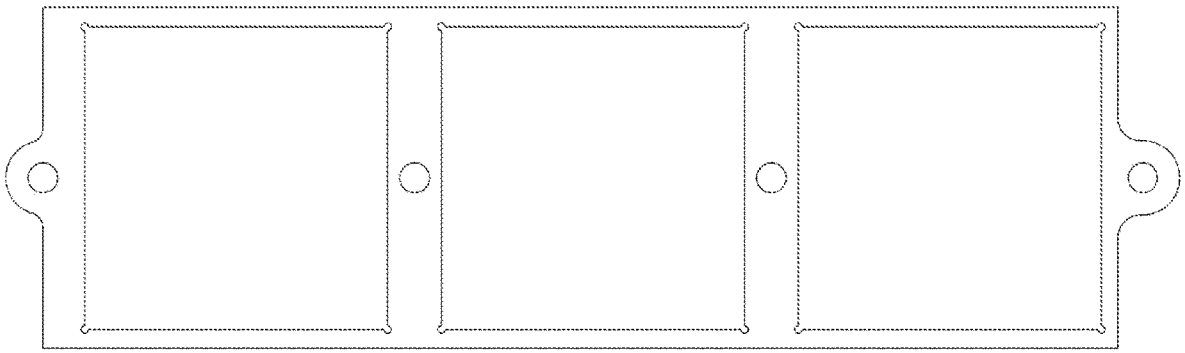
FIG. 10 is a schematic diagram of a power generation module fixed frame.

Referring to FIG. 9, the combustion-supporting cooling fan assembly 6 comprises a drive motor 6-1, a combustion-supporting impeller 6-2, a cooling impeller 6-3, a limit bracket 6-4 and a motor aluminum seat 6-5, the combustion-supporting impeller 6-2 and the cooling impeller 6-3 are mounted on the shaft body at both ends of the drive motor 6-1 respectively, wherein the size of the combustion-supporting impeller 6-2 is smaller than the size of the cooling impeller 6-3, and the limit bracket 6-4 fixes the position of the combustion-supporting cooling fan assembly 6 to avoid the scrape of the shell by the cooling impeller 6-3.

In the present embodiment, in order to ensure the normal combustion of the burner 1, the air outside the shell 5 is brought into the shell 5 and the burner 1 by means of the rotation of the combustion-supporting impeller 6-2, so as to realize the normal combustion of the fuel in the burner 1; the cooling impeller 6-3 brings the air into the shell 5, which flows through the radiators 4 to cool down the radiators 4.

Figure 13:
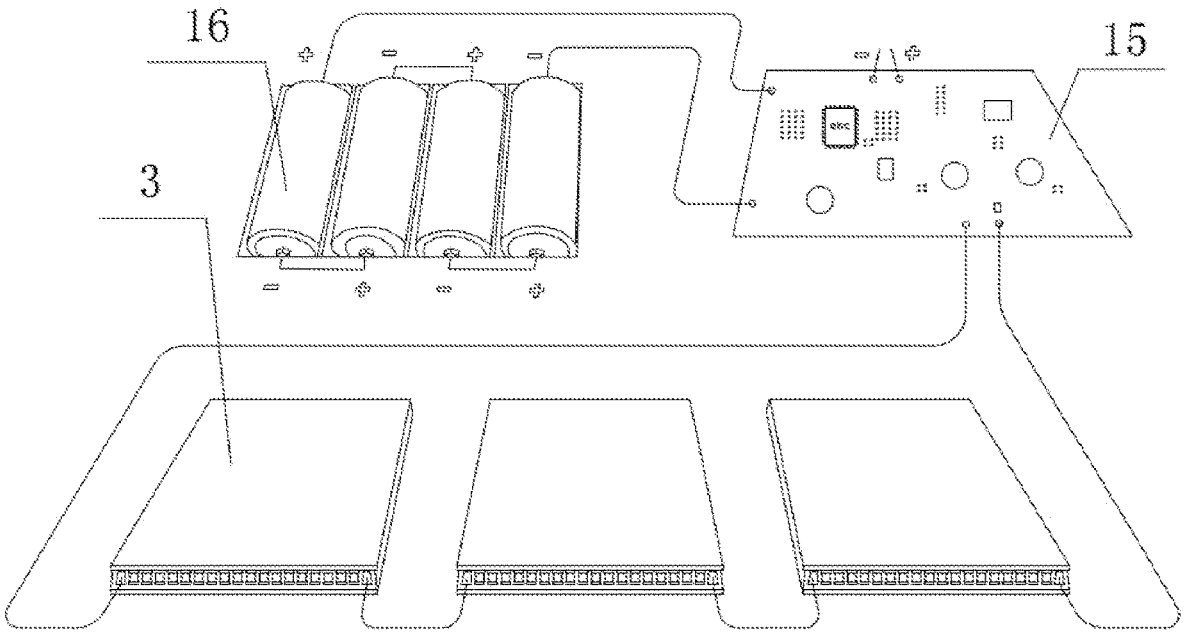
FIG. 13 is a schematic diagram showing two connecting wires on the thermoelectric power generation modules are connected to the power management system.

Referring to FIG. 13, two connecting wires on the thermoelectric power generation modules are connected to the power management system, and two connecting wires of the lithium battery pack are also connected to corresponding positions of the power management system.

In the present embodiment, the power management system and lithium battery pack are used. When the equipment is working, the thermoelectric power generation modules will send power to the power management system, which will then send power to the electrical components and recharge the lithium battery pack by means of judgment and distribution. The lithium battery pack is composed of multiple lithium batteries. When there is under voltage, the lithium battery pack can be pulled out, and the mains charging and on board charging can be adopted, which is convenient to use.

Although the present invention is described herein with reference to specific embodiments, it should be understood that these embodiments are merely illustrative of the principles and applications of the present invention. It is therefore to be understood that numerous modifications may be made to the exemplary embodiments and other arrangements may be devised without departing from the spirit and scope of the present invention as defined by the appended claims. It shall be understood that different dependent claims and features described herein may be combined in a way different from that described in the original claims. It will also be understood that features described in connection with individual embodiments can be used in other described embodiments.

What is claimed is:

1. A self-generating movable heat source, comprising a burner (1), a heat exchanger (2), a plurality of sets of thermoelectric power generation modules (3), a plurality of sets of radiators (4), a shell (5), a combustion-supporting cooling fan assembly (6), a thermoelectric power generation module fixed frame (7), an integrated graphite pad (8), a plurality of sets of outer hexagonal stud screws (9), spring pads (10), nuts (11), Y-shaped pressing pieces (12), I-shaped pressing pieces (13), L-shaped pressing pieces (14), a power management system (15), and a lithium battery pack (16);

wherein the burner (1), the heat exchanger (2), the plurality of sets of thermoelectric power generation modules (3), the thermoelectric power generation module fixed frame (7), the integrated graphite pad (8), and the plurality of sets of radiators (4) are sequentially arranged in the shell (5) from the inside to the outside, and the combustion-supporting cooling fan assembly (6) is arranged on one side of the heat exchanger (2);

wherein the burner (1) is inserted into the heat exchanger (2) and connected fixedly with the heat exchanger (2); the plurality of sets of thermoelectric power generation modules (3), the thermoelectric power generation module fixed frame (7), the integrated graphite pad (8), and the plurality of sets of radiators (4) are uniformly mounted on the outer wall of the heat exchanger (2) in the circumferential direction from inside to outside, and then compress and fix all fittings by means of the plurality of sets of outer hexagonal stud screws (9), the spring pads (10), the nuts (11), the Y-shaped pressing pieces (12), the I-shaped pressing pieces (13), and the L-shaped pressing pieces (14).

2. The self-generating movable heat source according to claim 1, wherein each set of radiators (4) comprises a cooling fin body (4-1) and a rectifying cover plate (4-2), after the cooling fin body (4-1) is mounted, the rectifying cover plate (4-2) is inserted into a fixing groove of the cooling fin body (4-1).

3. The self-generating movable heat source according to claim 1, wherein each set of outer hexagonal stud screws (9)

comprises a short limit outer hexagonal stud screw (9-1) and a long limit outer hexagonal stud screw (9-2), the short limit outer hexagonal stud screw (9-1) has a short hexagon, and the threaded part is inserted into the radiators (4), a long limit outer hexagonal stud screw (9-2) has a long hexagon and abuts against the end surface of the hexagon when the pressing piece is pressed.

4. The self-generating movable heat source according to claim 1, wherein the outer wall of the heat exchanger (2) is in the shape of a hexagonal prism, which is a barrel-shaped structure with one end open; the inner wall of the heat exchanger (2) is evenly provided with a plurality of heat exchange fins (2-1) along the circumferential direction, and the length direction of the heat exchange fins (2-1) is the same as the length direction of the burner (1).

5. The self-generating movable heat source according to claim 1, wherein the Y-shaped pressing pieces (12), the I-shaped pressing pieces (13), and the L-shaped pressing pieces (14) have different structural shapes depending on different mounting positions.

6. The self-generating movable heat source according to claim 1, wherein the integrated graphite pad (8) is disposed above the heat exchanger (2), and then the thermoelectric power generation module fixed frame (7) is disposed above the integrated graphite pad (8), the heat exchanger (2) is provided with 4 threaded holes corresponding to the holes on the thermoelectric power generation module fixed frame (7) and the integrated graphite pad (8), and then the short limit outer hexagonal stud screw (9-1) passes through the holes on the thermoelectric power generation module fixed frame (7) and the integrated graphite pad (8), and is screwed into the two threaded holes in the middle of the heat exchanger (2), and then the long limit outer hexagonal stud screw (9-2) passes through the holes on the thermoelectric power generation module fixed frame (7) and the integrated graphite pad (8), and is screwed into the two threaded holes at both ends of heat exchanger (2), and by means of the hexagonal end surface of the outer hexagonal stud screw (9), the thermoelectric power generation module fixed frame (7) and the integrated graphite pad (8) are securely fixed on the heat exchanger (2), and then the thermoelectric power generation modules (3) is disposed into the groove of the thermoelectric power generation module fixed frame (7) to position and fix the thermoelectric power generation modules (3).

7. The self-generating movable heat source according to claim 6, wherein the integrated graphite pad (8) is disposed on the thermoelectric power generation modules (3) through the outer hexagonal stud screw (9), and the cooling fin body (4-1) is disposed on the integrated graphite pad (8) through the outer hexagonal stud screw (9), and then the Y-shaped pressing pieces (12), the I-shaped pressing pieces (13) and the L-shaped pressing pieces (14) are disposed on the cooling fin body (4-1) through the outer hexagonal stud screw (9) depending on different positions, and then the spring pads (10) and nuts (11) are sleeved on the outer hexagonal stud screw (9) and the nuts (11) are tightened, so that the lower planes of the Y-shaped pressing pieces (12), the I-shaped pressing pieces (13) and the L-shaped pressing pieces (14) abut against the upper surface of the hexagon of the outer hexagonal stud screw (9), and the rectifying cover plate (4-2) is inserted into the fixing groove of the cooling fin body (4-1).

8. The self-generating movable heat source according to claim 1, wherein the combustion-supporting cooling fan assembly (6) comprises a drive motor (6-1), a combustion-supporting impeller (6-2), a cooling impeller (6-3), a limit bracket (6-4) and a motor aluminum seat (6-5), the combustion-supporting impeller (6-2) and the cooling impeller (6-3) are mounted on the shaft body at both ends of the drive motor (6-1) respectively, wherein the size of the combustion-supporting impeller (6-2) is smaller than the size of the cooling impeller (6-3), and the limit bracket (6-4) fixes the position of the combustion-supporting cooling fan assembly (6) to avoid the scrape of the shell by the cooling impeller (6-3).

9. The self-generating movable heat source according to claim 1, wherein the shell (5) is a cylindrical structure, and two ends of the shell (5) are provided with air inlets and air outlets.

10. The self-generating movable heat source according to claim 1, wherein two connecting wires on the thermoelectric power generation modules (3) are connected to the power management system (15), and two connecting wires of the lithium battery pack (16) are also connected to corresponding positions of the power management system (15).

* * * * *